United States Patent [19]

Leightner

[11] 4,152,969

[45] May 8, 1979

[54] FIRE CONTROL CORRECTION SYSTEM FOR WIND AND TARGET MOTION

[75] Inventor: Robert A. Leightner, Arlington, Vt.

[73] Assignee: The United States of America as represented by the Secretary of the Navy, Washington, D.C.

[21] Appl. No.: 678,093

[22] Filed: Apr. 19, 1976 (Under 37 CFR 1.47)

[51] Int. Cl.[2] ..... F41G 3/24

[52] U.S. Cl. ..... 89/41 EA; 364/423

[58] Field of Search ..... 33/238, 239; 89/41 E, 89/41 EA, 41 LE; 364/423

[56] References Cited

U.S. PATENT DOCUMENTS

| | | | |
|---|---|---|---|
| 2,693,031 | 11/1954 | Clark | 364/423 |
| 3,309,963 | 3/1967 | Salomonsson | 364/423 |
| 3,739,152 | 6/1973 | Frohock et al. | 364/423 |
| 4,011,789 | 3/1977 | Bresee et al. | 89/41 EA |

*Primary Examiner*—Stephen C. Bentley
*Attorney, Agent, or Firm*—R. S. Sciascia; W. Thom Skeer

[57] ABSTRACT

A fire control correction system for wind and target motion in an airborne fire control system which comprises using the gun slave resolver chain to perform trigonometric resolutions for wind and target motion corrections, in addition to normal function of directing the gun from the sighting station.

2 Claims, 2 Drawing Figures

NOTE:
$\eta_T$ IS TOTAL ∡, SUM OF $\eta_o$ AND $\eta_I$ MEASURED FROM TURRET BASE.
$\xi_T$ IS TOTAL ∡, SUM OF $\xi_I$ AND 22½°, MEASURED FROM TURRET BASE.

FIRE CONTROL CORRECTION SYSTEM FOR WIND AND TARGET MOTION

BACKGROUND OF THE INVENTION

The invention is concerned with providing a wind and target motion correction for an airborne fire control system.

SUMMARY OF THE INVENTION

The invention comprises a method of providing an exact solution for local wind and apparent target motion, with an inherent advantage of a substantial hardware savings, for an airborne fire control system.

This is accomplished by calculating lead angle or velocity jump and inserting the corrections corresponding thereto into the resolvers of the gun sight.

DESCRIPTION OF THE PREFERRED EMBODIMENT

Figure 1:
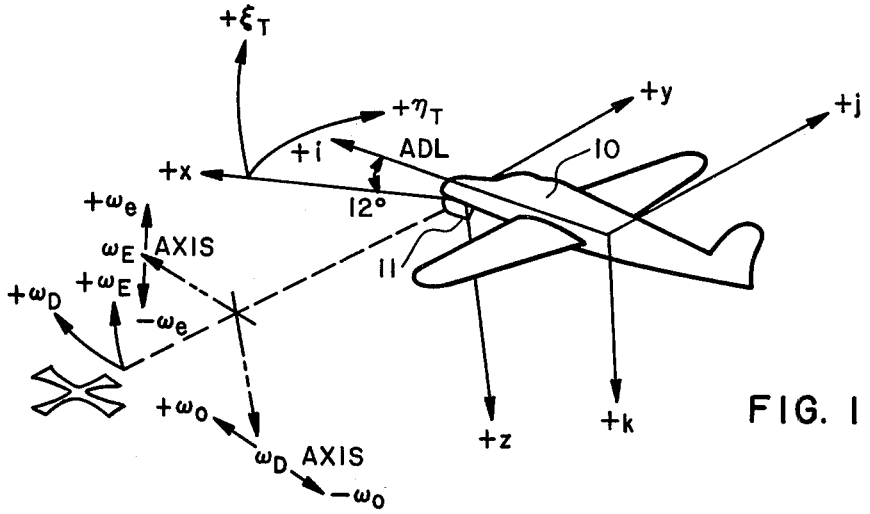
FIG. 1 depicts variables and their polarities.

FIG. 1 depicts a representation of an aircraft 10 having a Forward Looking InfraRed (FLIR) turret 11 thereon. The variables and their polarities are indicated on FIG. 1 whereon:

$\xi_T$=Elevation of the line of sight with respect to the FLIR turret tipped down 12° from aircraft datum line (ADL). Positive angles up.

$\eta_T$=Azimuth or train of the line of sight with respect to the FLIR turret base. Positive angles clockwise from above.

x, y, z=Orthogonal coordinate system aligned with the FLIR and gun turret base, x positive forward, y positive athwart starboard, z positive down.

i, j, k=Orthogonal coordinate system aligned with the airframe datum line, i positive forward, j positive athwart starboard, k positive down.

$\omega_E$=Line of sight rate about the elevation axis of both FLIR and gun turret, positive rate gives increasing positive angle.

$\omega_D$=Line of sight rate in traverse, or that axis that is orthogonal to the elevation axis and the line of sight. Positive rate gives increasing positive azimuth angle for $\xi_T$ from 0° to <90°.

$V_s$=Indicated airspeed measured by pilot system, independent of yaw angle up to 20° and angle of attack angles between −10° and +24°.

$V_g$=Gravity velocity vector associated with superelevation.

$V_M$=Projectile muzzle velocity=3320 feet per sec.

R=Roll angle of airframe, measured about axis that is orthogonal to i axis, starboard wing down positive roll.

P=Pitch angle of airframe, measured about axis that is orthogonal to i axis and the direction of gravity, aircraft climb positive.

T=Temperature in degrees Rankin.

$P_s$=Static (barometric) pressure in inches of mercury.

$\xi_s$=Elevation of the line of sight with respect to the aircraft datum line, positive angles up.

$\eta_s$=Azimuth of the line of sight with respect to the aircraft datum line, positive angles clockwise from above.

$R_L$=Range to target measured along the line of sight by the laser designator/rangefinder.

$R_{(triangulation)}$=Range to target computed using altitude and angle information.

H=Height above terrain measured perpendicular to the ground.

$E_G$=Elevation of the gun with respect to the turret, positive angles up.

$T_G$=Azimuth or train of the gun with respect to the turret, positive angles clockwise from above.

Figure 2:
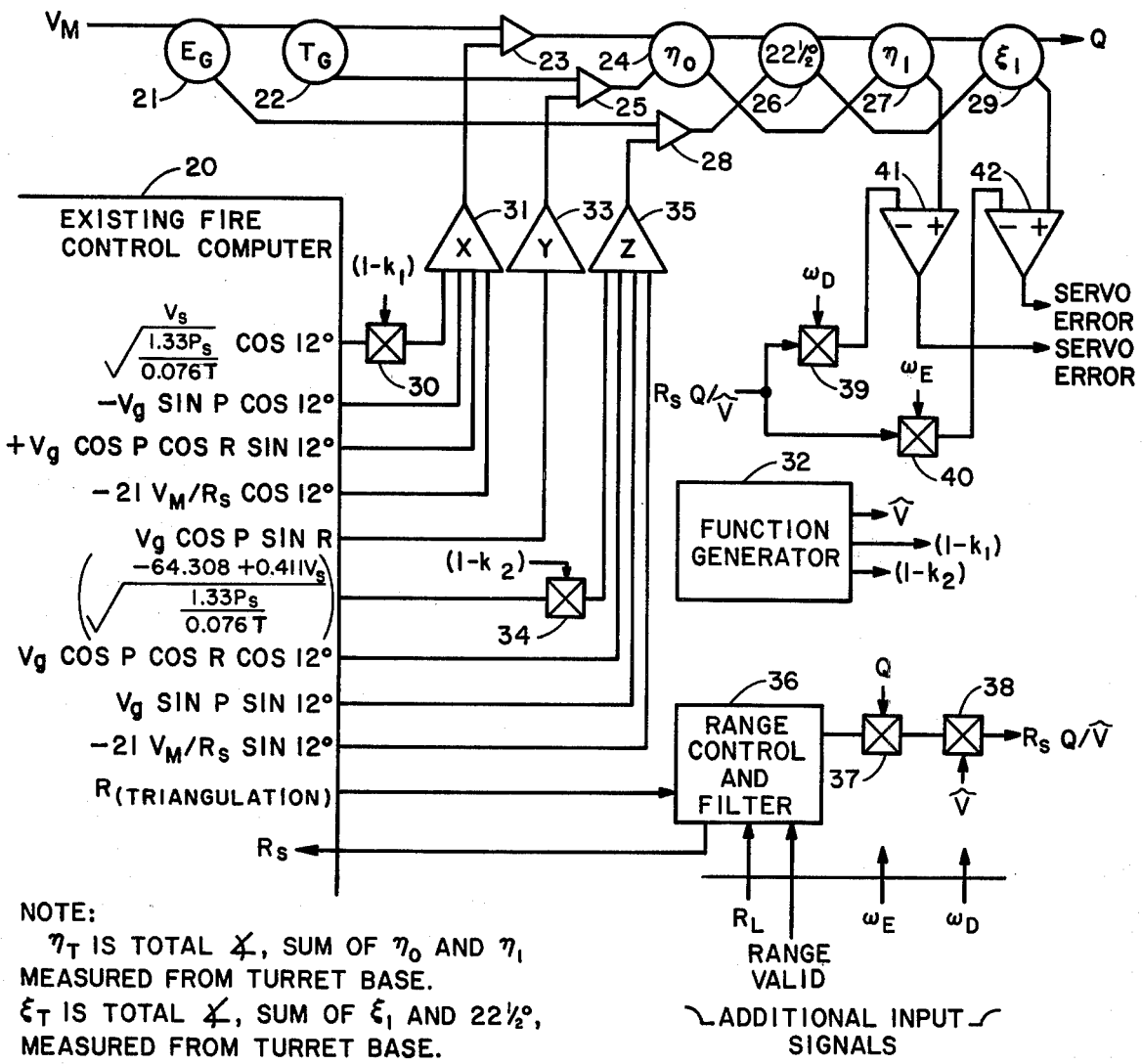
FIG. 2 is a block diagram of a preferred embodiment of the invention.

FIG. 2 is a block diagram of a preferred embodiment of the invention wherein an existing fire control computer 20 is shown and the various outputs generated thereby.

$V_M$ is coupled into elevation gimbal gun resolver 21 which in turn outputs a signal to azimuth gimbal gun resolver 22.

One output from resolver 22 is coupled through an operational amplifier 23 to an input on an outside azimuth FLIR gimbal resolver 24 while another output is also coupled through an operational amplifier 25 to another input to the resolver 24.

One output of resolver 24 is coupled to outside FLIR gimbal resolver 26 which has a fixed 22½° depression angle.

Another output of resolver 24 is coupled as one input to inside azimuth FLIR gimbal resolver 27 which also receives another input from the output of resolver 24.

Another output of resolver 21 is coupled through operational amplifier 28 as another input to the resolver 26 also.

One output of resolver 27 is coupled as one input to inside elevation FLIR gimbal resolver 29 which also receives as another input, another output from resolver 26. One output of resolver 29 corresponds to Q.

A signal corresponding to $$\frac{V_s}{\sqrt{\frac{1.33P_S}{0.076T}}}$$

cos 12° from computer 20 is coupled through multiplier 30 and operational amplifier 31 as another input to operational amplifier 23. Multiplier 30 also receives another input corresponding to $(1-k_1)$ from a function generator 32.

Operational amplifier 31 also receives three other outputs from computer 20 corresponding to $-V_g \sin P \cos 12°$, $+V_g \cos P \cos R \sin 12°$ and $-21\ V_M/R_X \cos 12°$.

An output from computer 20 corresponding to $V_g \cos P \sin R$ is coupled through operational amplifier 33 as another input to operational amplifier 25.

An output corresponding to $$\frac{-64.308 + 0.411V_s}{\sqrt{\frac{1.33P_s}{0.076T}}}$$

is coupled as one input to a multiplier 34 which also receives another input corresponding to $(1-k_2)$ from function generator 32.

Another operational amplifier 35 receives as one input the output of multiplier 34 as well as three other outputs from computer 20 corresponding to: $V_g \cos P \cos R \cos 12°$, $V_g \sin P \sin 12°$ and $-21\ V_M/R_s \sin 12°$. The output of operational amplifier 35 is coupled as another input to operational amplifier 28.

$R_{(Triangulation)}$ is outputted from computer 20 as one input to a range control and filter 36 which also receives additional inputs corresponding to $R_L$ and a valid range signal. Range control and filter 36 outputs a signal corresponding to $R_s$ to computer 20 and another signal to multiplier 37.

Multiplier 37 receives another input corresponding to Q and outputs a signal to an input of multiplier 38 which also receives another input corresponding to $\hat{V}$ from function generator 32. The output of multiplier 38 corresponds to $R_s Q/\hat{V}$.

The output of multiplier 38 is coupled as one input to multipliers 39 and 40. Another input to multiplier 39 is $\omega_D$ and another input to multiplier 40 is $\omega_E$.

The output of multiplier 39 is coupled to the negative input of operational amplifier 41 and the output of resolver 27 is coupled to the positive input of operational amplifier 41.

The output of multiplier 40 is coupled to the negative input of operational amplifier 42 and the output of resolver 29 is coupled to the negative input of the same operational amplifier.

The outputs of amplifiers 41 and 42 are used to force resolvers 21 and 22 to the equality situation defined by the equations for $E_G$ and $T_G$ which will be explained subsequently.

In the wind and target motion correction mode and with a valid laser range, the computer 20 will implement a gun angle correction as follows:

$$E_G = \arc\sin \frac{Q \sin \xi_T + R_L \omega_E Q/\hat{V} \cos \xi_T + V_Z}{V_M} \quad (1)$$

(pos $V_Z$ for superelevation)

$$T_G = \arc\sin \frac{(Q \cos \xi_T - \sin \xi_T R_L \omega_E Q/\hat{V}) \sin \eta_T + R_L \omega_D Q/\hat{V} \cos \eta_T - V_Y}{V_M \cos E_G} \quad (2)$$

where:

$$Q = [(V_M \cos E_G \cos T_G + V_X) \cos \eta_T + (V_M \cos E_G \sin T_G + V_Y) \sin \eta_T] \cos \xi_T + (V_M \sin E_G - V_Z) \sin \xi_T$$

$$V_x = \frac{V_s}{\sqrt{17.3352 \frac{P_s}{T}}} \cos 12° (1 - k_1) - V_g \sin P \cos 12° + V_g \cos P \cos R \sin 12° - 21 \frac{V_m}{R_s} \cos 12°$$

$$V_y = V_g \cos P \sin R$$

$$V_z = \left( \frac{+64.308 - .411 V_s}{\sqrt{17.3352 \frac{P_s}{T}}} \right) (1 - k_2) + V_g \cos P \cos R \cos 12° + V_g \sin P \sin 12° + 21 \frac{V_m}{R_s} \sin 12°$$

$$k_1 = \frac{Q}{\hat{V}} \qquad k_2 = \left| \frac{Q}{\hat{V}} \right|$$

$$R_L = 3000'$$

$$V_g = \left( \frac{34.58(10)^{-6} P_s}{T} - 7.6867 (10)^{-9} \right) (1.2737 R_s^2 + 660.65 R_s)$$

$$\hat{V} = \frac{Q R_L}{V_m \left( \frac{-0.30413}{V_g} + 0.26506 - [.10278 + .00011682 R_L] \left( \frac{17.3352 P_s}{T} - 1 \right) + 0.04104 V_g \right)}$$

$$R_s = R_L$$

In the absence of a valid laser range, the computer is reconfigured to the original by forcing $\omega_E$, $\omega_D$, $k_1$, $k_2$ to zero and $R_s$ to R (from triangulation).

Equations (1) and (2) above are implemented with the computing resolvers of FIG. 2. The equations are ambiguous beyond ±90° even though the resolvers are unambiguous throughout 360°. This is because the resolver simultaneously solves an identical arc consine equation as follows:

$$T_G = \frac{\arc\cos(Q \cos \xi_T \cdot \sin E_T R_L \omega_E \frac{Q}{\hat{V}}) \cos \eta_T - R_L \omega_D \frac{Q}{\hat{V}} \sin \eta_T - V_x}{V_M \cos E_G}$$

Although the elevation resolver solves a similar arc cos equation, there is no ambiguity in that elevation coverage is limited to 64°.

A hardware savings results from using the gun slave resolver chain to perform the trigonometric resolutions for the wind and target motion corrections, in addition to its normal function of directing the gun. Trigonometric resolutions are required to combine the corrections, some of which are in the Cartesian coordinates of the turret mount and others that are with reference to the line of sight.

By inserting the corrections into different portions of the gun slave chain in the proper sense, the gun angle is constructed out of the combined corrections.

Lead angle or velocity jump is calculated from range times rate (angular rate of the line of sight) times a function of $\hat{V}$ (average projectile velocity to impact). This implements a correction for wind and target motion, a correction which is too large an angle if it were derived from airspeed. As lead angle is incurred from both, a quantity proportional to true airspeed is subtracted. This accounts for the portion of the angular rate of the line of sight that comes from the aircraft's speed.

Corrections formed with the rates are in the coordinates of the FLIR gyros, attached to the line of sight. The corrections are inserted into the resolvers of the sight. The remaining corrections are in Cartesian coordinates of the airframe, either from the pitot probe or vertical reference gyro on board the aircraft. These are added to the resolver signals when they are in a direction cosine form (between the gun and FLIR turrets).

What is claimed is:

1. A fire control system for directing an aircraft mounted gun toward a ground target from an operational point spaced from said gun on said aircraft using a guidance system located on said aircraft at a position remote from both said gun and said operational point comprising:

first azimuth and first elevation gimbal resolver means having inputs and outputs configured to receive and transmit a muzzle velocity signal and mounted on said gun for servo guidance thereof;

second azimuth and second elevation gimbal resolver means having an input connected to said first azimuth and elevation gimbal resolvers respectively and configured to receive and transmit said muzzle velocity signal transmitted thereby and mounted on said guidance system for servo control thereof and having a second input;

third azimuth and third elevation gimbal resolver means mounted at said operational point to direct aim at a selected target on the ground and having inputs and outputs effectively connected to said second azimuth and second elevation gimbal resolvers respectively for receipt of said muzzle velocity signal transmitted thereby and having second inputs;

a computer having a plurality of outputs effectively connected to said second azimuth gimbal resolver means including;

a first output connected to said muzzle velocity signal input of said second azimuthal gimbal resolver, a second output connected to said second azimuthal gimbal resolver at said second input thereto, a third output connected to said second elevation gimbal resolver at said second input thereof;

operational amplifier means connected to the outputs of said third azimuth and elevation gimbal resolver means for generating servo error signals to be used in directing said gun, whereby the resolvers are continuously used to control the direction of aim of said gun.

2. A method for directing a gun having servo control including azimuth and elevation gimbal resolvers from a moving platform toward a stationary target remote from said moving platform comprising the steps of:

serially transmitting a muzzle velocity analog signal through the azimuth and elevation gimbal resolvers of said gun servo serially transmitting said muzzle velocity analog signal through azimuth and elevation resolvers on a traget location system remotely positioned on said moving platform with respect to said gun;

inserting signals into said serially connected signal having predetermined values with respect to air speed, roll, pitch of said moving platform, barometric pressure and temperature of the air surrounding said moving platform, slant range to said target, and the average velocity of said projectile to produce a servo error signal for said servo control, said values being predetermined to provide a gun elevation angle, $E_G$, equal to an angle the sin of which is, $$\frac{Q \sin \xi_t + R_L \omega_E Q / \cos \xi_T + V_z}{V_M}$$

and a gun azmuth angle, $T_G$, the sine of which is, $$\frac{(Q \cos \xi_T - \sin \xi_T R \omega_E Q/) \sin \eta_T + R_L \omega_D Q / \cos \eta_T - V_Y}{V_M \cos E_G}$$

* * * * *